US007651402B2

(12) United States Patent
Ochi

(10) Patent No.: US 7,651,402 B2
(45) Date of Patent: Jan. 26, 2010

(54) RETRACTABLE PROTECTOR MEMBER FOR BOWLING LANE APPROACH SECTION

(75) Inventor: Yasushi Ochi, Izumisano (JP)

(73) Assignee: BLD Oriental, Ltd., Osaka (JP)

( * ) Notice: Subject to any disclaimer, the term of this patent is extended or adjusted under 35 U.S.C. 154(b) by 0 days.

(21) Appl. No.: 12/295,044

(22) PCT Filed: Jan. 26, 2007

(86) PCT No.: PCT/JP2007/051232

§ 371 (c)(1),
(2), (4) Date: Sep. 29, 2008

(87) PCT Pub. No.: WO2007/116596

PCT Pub. Date: Oct. 18, 2007

(65) Prior Publication Data

US 2009/0280917 A1 Nov. 12, 2009

(30) Foreign Application Priority Data

Mar. 31, 2006 (JP) ..... 2006-097221

(51) Int. Cl.
*A63D 1/04* (2006.01)

(52) U.S. Cl. ..... 473/55; 473/117

(58) Field of Classification Search ..... 473/55, 473/115, 116, 117
See application file for complete search history.

(56) References Cited

U.S. PATENT DOCUMENTS 1,829,239 A 10/1931 Schnitman
2,296,471 A 9/1942 Kennedy
2,686,054 A 8/1954 Coroniti (Continued)

FOREIGN PATENT DOCUMENTS

JP 52-5668 U 1/1977

(Continued)

OTHER PUBLICATIONS

International Search Report of PCT/JP2007/051232, date of mailing Mar. 6, 2007.

*Primary Examiner*—William M Pierce
(74) *Attorney, Agent, or Firm*—Westerman, Hattori, Daniels & Adrian, LLP

(57) ABSTRACT

The present invention relates to a bowling game system in which a play is possible without changing into bowling shoes. A bowling game system 1 includes: an approach 10 for allowing a player to carry out a bowling action; a lane 11 extending from the approach 10 and on which a ball bowled by the player rolls; a plurality of pins 12 arranged and placed on an end of the lane 11 opposite a side of the approach 10; trough-like gutters 13 provided paralleling both sides of the lane 11 to receive a ball slipping off the lane 11; a protection member 20, formed in a sheet-like shape, for covering a bowling action zone, the protection member 20 being laid in the bowling action zone of the player, the bowling action zone being on a top surface of the approach 10; and a protection-member installing mechanism 30 configured with a wind-in device 31 for winding in and collecting the protection member 20 in a retracting position outside the bowling action zone and a withdrawing device 34 for withdrawing the protection member 20 from the wind-in device 31 to a position covering the bowling action zone.

5 Claims, 9 Drawing Sheets

U.S. PATENT DOCUMENTS

| | | | | |
|---|---|---|---|---|
| 4,944,514 | A * | 7/1990 | Suiter | 473/117 |
| 5,348,513 | A * | 9/1994 | Heddon | 473/117 |
| 5,472,381 | A * | 12/1995 | Ayre, Jr. | 473/115 |
| 5,589,013 | A * | 12/1996 | Stepanek | 156/71 |
| 5,849,384 | A * | 12/1998 | Stepanek | 428/40.1 |
| 5,873,972 | A * | 2/1999 | Barnett | 156/270 |
| 5,948,510 | A * | 9/1999 | Barnett | 428/192 |
| 7,022,024 | B2 * | 4/2006 | Brim et al. | 473/115 |
| 7,045,194 | B2 * | 5/2006 | Sneed | 428/156 |
| 7,597,949 | B2 * | 10/2009 | Wright | 428/116 |
| 2001/0002615 | A1 * | 6/2001 | Lacross et al. | 160/351 |
| 2005/0020368 | A1 * | 1/2005 | Burkholder et al. | 473/115 |
| 2005/0037853 | A1 * | 2/2005 | Brim et al. | 473/115 |

FOREIGN PATENT DOCUMENTS

| | | | |
|---|---|---|---|
| JP | 60-160917 | A | 8/1985 |
| JP | 2-79990 | U | 6/1990 |
| JP | 2002-227117 | A | 8/2002 |

* cited by examiner

RETRACTABLE PROTECTOR MEMBER FOR BOWLING LANE APPROACH SECTION

TECHNICAL FIELD

The present invention relates to a bowling game system in which for enjoyment a ball is rolled down a lane at a head of which a plurality of pins are arranged and placed, and the pins are knocked down by the rolling ball.

BACKGROUND ART

Such bowling game systems are configured with: an approach where players carry out a bowling action; a lane extending from the approach and on which the ball bowled by the player rolls; a plurality of pins placed on an end of the lane opposite a side of the approach; and trough-like gutters provided paralleling both sides of the lane to receive the ball slipping off the lane. Players enjoy the game by competing with each other for a higher score that depends on the number of pins they knock down (see Patent document 1).

Patent document 1: Japanese Unexamined Patent Application Publication No. 2005-334224

DISCLOSURE OF INVENTION

Problem Invention is to Solve

Normally, when a player plays the bowling, for example, as described in Japanese Unexamined Patent Application Publication No. 2004-49477, there is a need of changing into bowling shoes. However, at this time, most of the players do not have their own shoes, and thus, the players need to borrow and use rental shoes available at a bowling alley.

The reason for changing into the bowling shoes is to protect the approach and to become functional in playing the bowing. However, the bowling shoes available at the bowling alley have various problems. For example, these shoes are used by an unspecified number of players or are not excellent in design. Therefore, there are many players who feel reluctant to change into the rental bowling shoes. Some players desire to play more easily without a need of changing the shoes. Further, when the rental bowling shoes are borrowed, a rental fee needs to be paid, which results in a factor leading to an increased playing charge.

The present invention has been achieved in view of the aforementioned circumstances, and an object thereof is to provide a bowling game system capable of playing without changing into bowling shoes.

Means for Resolving the Problem

To achieve the above-described object, the present invention relates to a bowling game system, comprising:

an approach for allowing a player to carry out a bowling action; a lane extending from the approach and on which the ball bowled by the player rolls; a plurality of pins arranged and placed on an end of the lane opposite a side of the approach; and trough-like gutters provided paralleling both sides of the lane to receive a ball slipping off the lane, the bowling game system, further comprising:

a protection member, formed in a sheet-like shape, for covering a bowling action zone, the protection member being laid in the bowling action zone of the player, the bowling action zone being on a top surface of the approach; and a protection-member installing mechanism for carrying out an action of moving the protection member to a position covering the bowling action zone and an action of moving the protection member to a retracting position outside the bowling action zone.

According to the present invention, when the player does not change into bowling shoes, the protection member is moved in the bowling action zone on the top surface of the approach by the protection-member installing mechanism, and thereby, the protection member is laid in the bowling action zone to cover the bowling action zone. Thereafter, the player carries out a bowling action in the bowling action zone on the top surface of the approach covered with the protection member with his own shoes on. In this way, the player can play a bowling game by bowling a ball onto the lane so as to strike the ball against the pins to be knocked down.

On the other hand, when the player changes into the bowling shoes, the protection member is moved to the retracting position outside the bowling action zone by the protection-member installing mechanism. Thereby, the top surface of the approach is in an exposed state. Thereafter, the player carries out the bowling action in the bowling action zone on the top surface of the approach not covered with the protection member to bowl the ball onto the lane, and in this way, the player can play the bowling game.

Thus, according to the bowling game system of the present invention, when the protection member is laid in the bowling action zone on the top surface of the approach by the protection-member installing mechanism, the player can play with his own shoes on without changing into bowling shoes. This eliminates the reluctance to change into shoes put on by others and shoes poor in design, which allows the player to play more comfortably, the player is allowed to play more easily because there is no need of changing the shoes, and a playing charge can be lowered because there is no need of paying a rental fee of the bowling shoes.

The protection-member installing mechanism may be configured with: winding-in means for winding in the protection member, the winding-in means being provided outside the bowling action zone and being connected with one end of the protection member; and withdrawing means for withdrawing the protection member from the winding-in means, the withdrawing means being connected with an end of the protection member opposite a side of a connection of the winding-in means, and the protection-member installing mechanism may be so configured that the protection member is wound out by the withdrawing means to within the bowling action zone and the protection member present within the bowling action zone is wound and collected by the winding-in means to the retracting position.

Further, the protection-member installing mechanism may be configured with driving means that is connected to the protection member, for sliding and moving the protection member in a first direction parallel to a surface of the protection member so as to move the protection member to the bowling action zone while sliding and moving the protection member in a second direction opposite the first direction so as to move the protection member to the retracting position. In this case, the protection-member installing mechanism may be configured to further include guiding means for guiding the movement of the protection member in the first direction and the second direction.

In this way, when the protection-member installing mechanism is configured with the winding-in means and the withdrawing means, or the driving means, the protection member can be effectively moved between the bowling action zone and the retracting position. The provision of the guiding means secures a smooth movement of the protection member, which is preferable for moving the protection member.

The bowling game system may be configured to further include clamping means for clamping at least one portion of a periphery of the protection member laid in the bowling action zone, on the top surface of the approach. In this way, the periphery of the protection member can be clamped on the top surface of the approach by the clamping means. This clamping prevents the protection member from moving and being turned over at a time of bowling by the player, thereby, enabling the player to play safely, and also from being damaged resulting from the approach being directly treaded by the player.

The protection member is not limited to a member having flexibility and may be configured with a member not having flexibility. Further, the protection member may be configured with a film-shaped, sponge-shaped, or rubber-shaped member, or may be configured by joining a plurality of plate-shaped members in a predetermined direction.

EFFECTS OF THE INVENTION

As described above, according to the bowling game system of the present invention, it is possible to play without changing into the bowling shoes, and thus, the player can enjoy the bowling game more comfortably, more easily, and more reasonably, as compared to the conventional technique.

LEGEND

Figure 1:
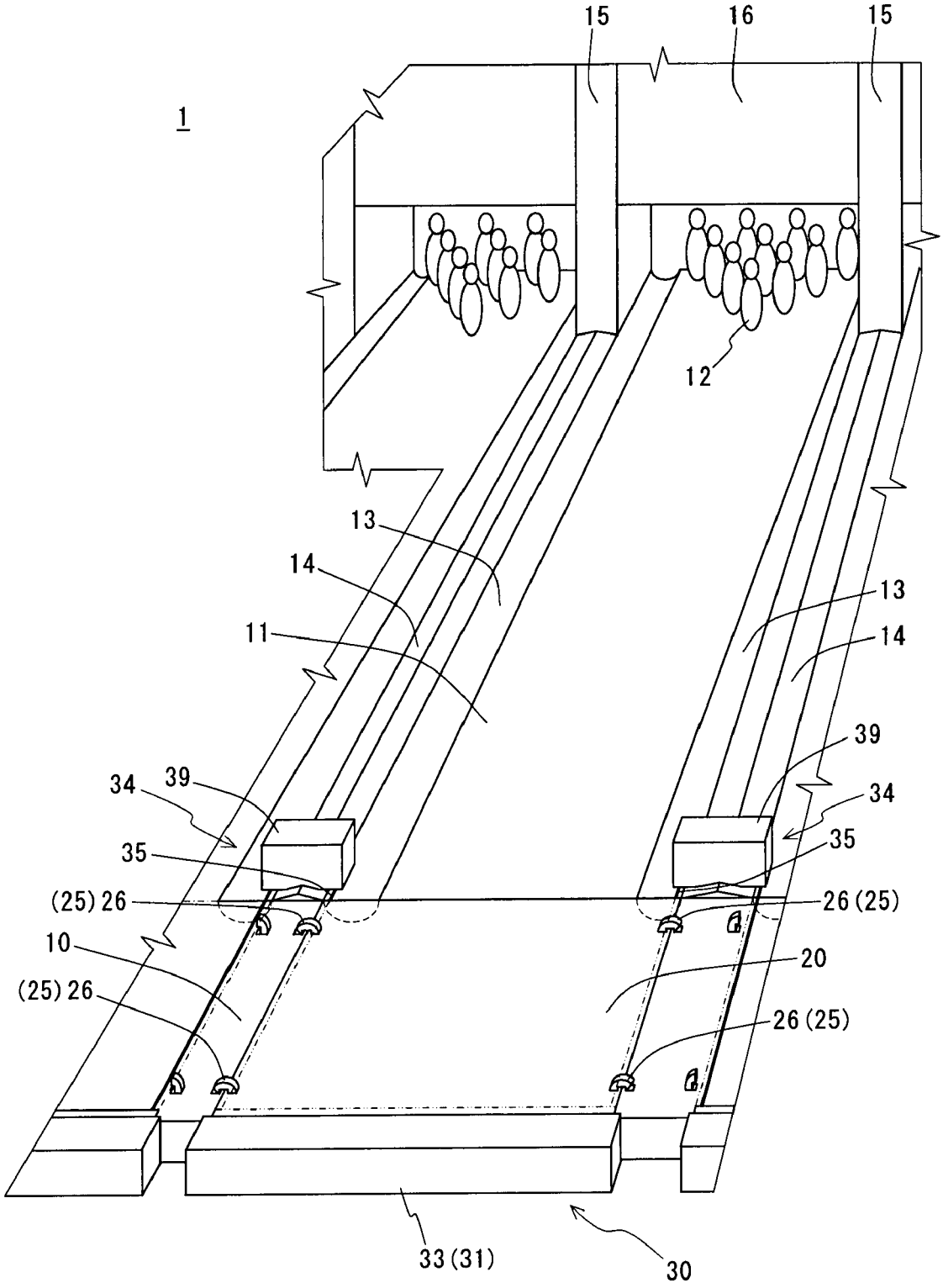
FIG. 1 is a perspective view illustrating a schematic configuration of a bowling game system according to one embodiment of the present invention.

1 Bowling game system
10 Approach
11 Lane
12 Pin
13 Gutter
14 Separator
20 Protection member
25 Clamping mechanism
26 Pressing member
27 Drive cylinder
30 Protection-member installing mechanism
31 Wind-in device
32 Wind-in drum
33 Case
34 Withdrawing device
35 Wire rope
36 Pulley
37 Wind-in drum
38 Drive motor
39 Case

BEST MODE FOR CARRYING OUT THE INVENTION

Figure 2:
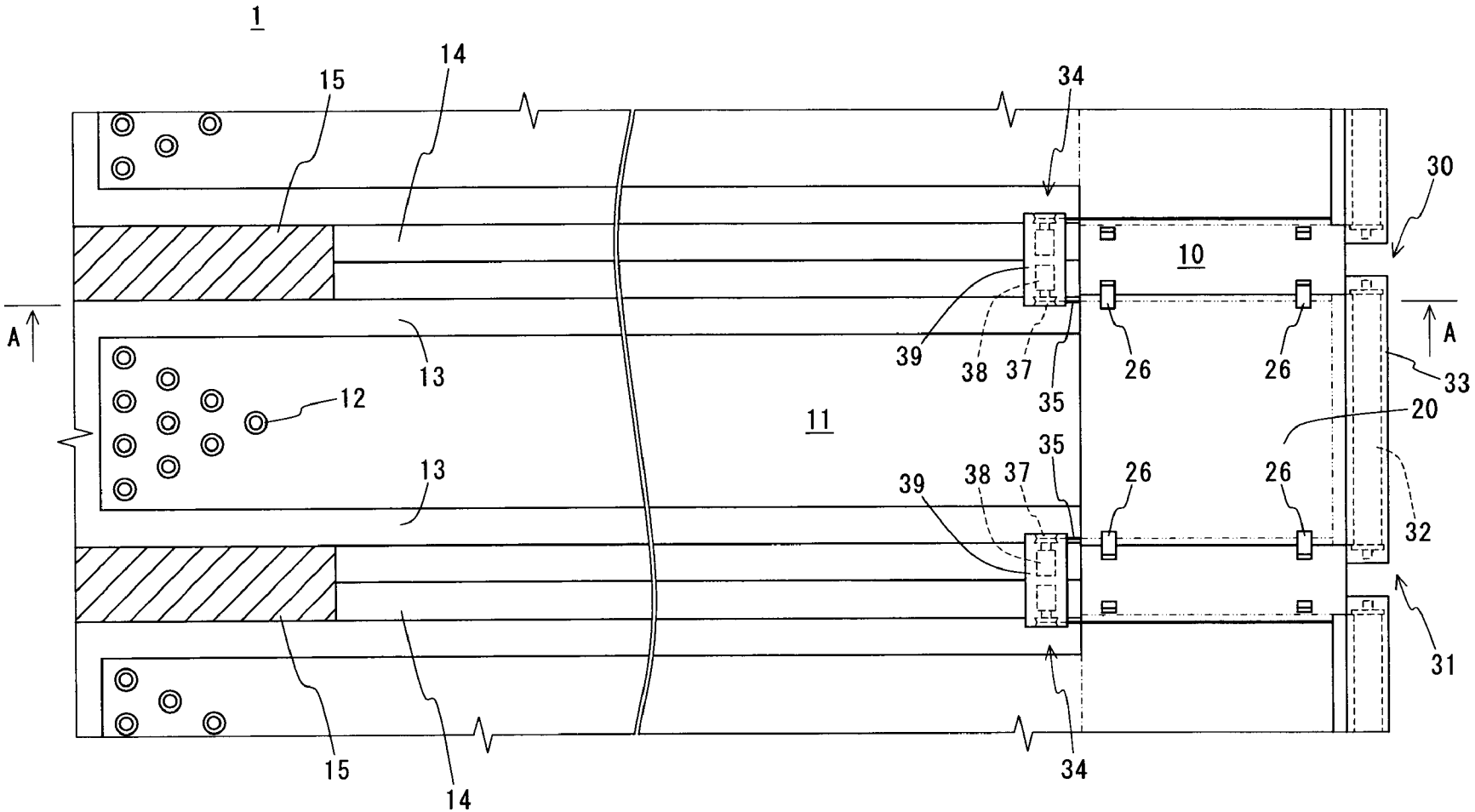
FIG. 2 is a plan view illustrating the bowling game system shown in FIG. 1.
Figure 3:
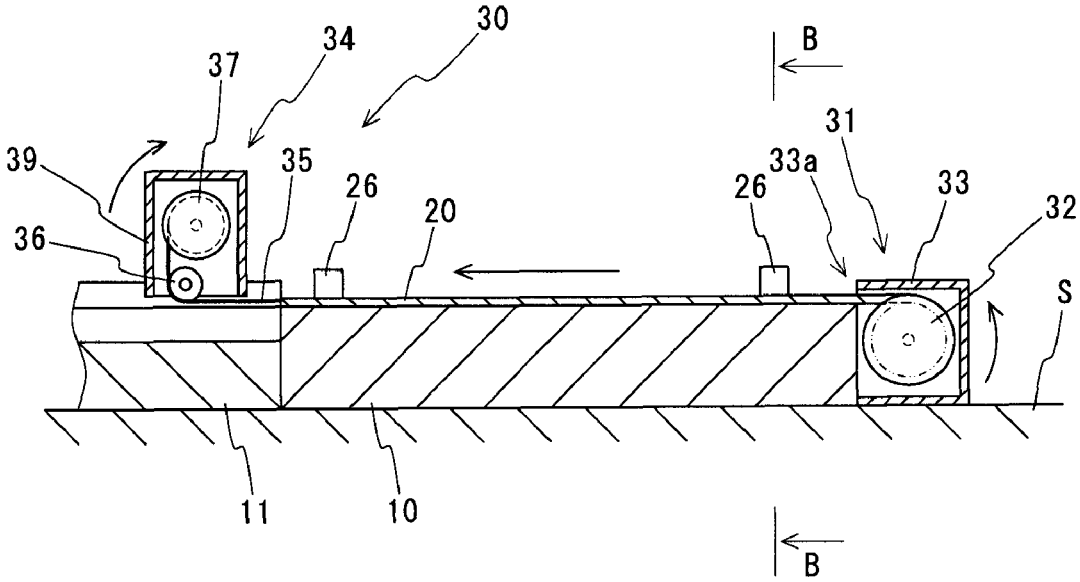
FIG. 3 is a cross-sectional view as viewed in the arrow A-A direction in FIG. 2.
Figure 4:
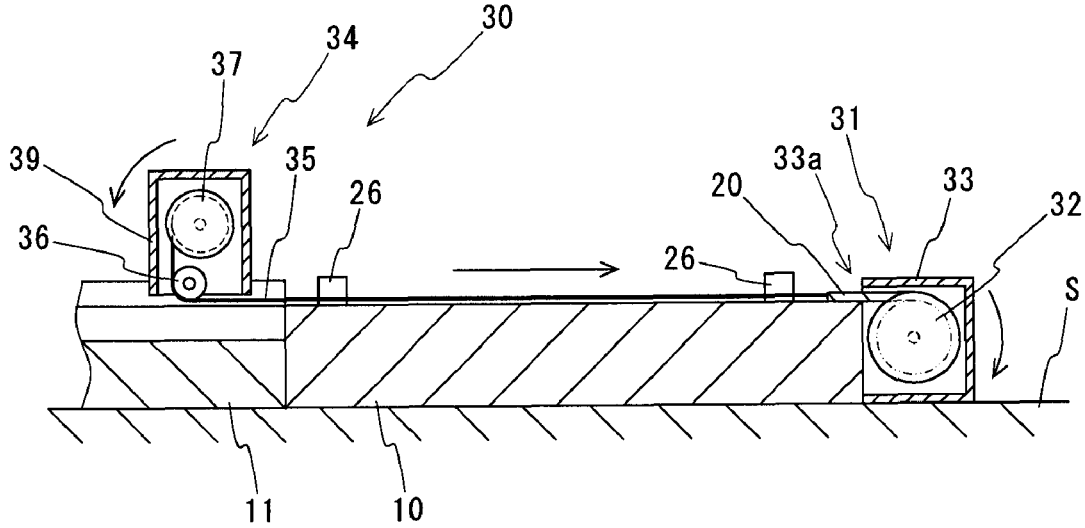
FIG. 4 is a cross-sectional view as viewed in the arrow A-A direction in FIG. 2.
Figure 5:
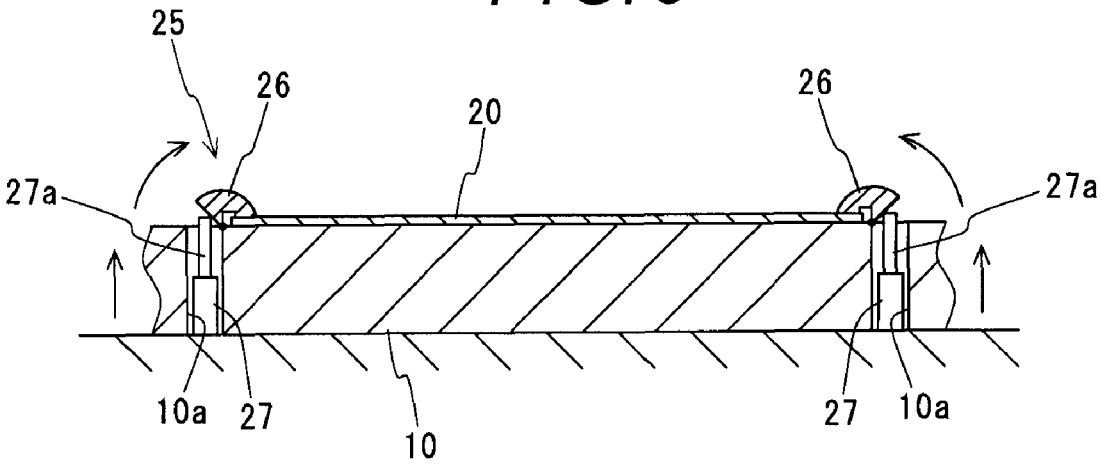
FIG. 5 is a cross-sectional view as viewed in the arrow B-B direction in FIG. 3.
Figure 6:
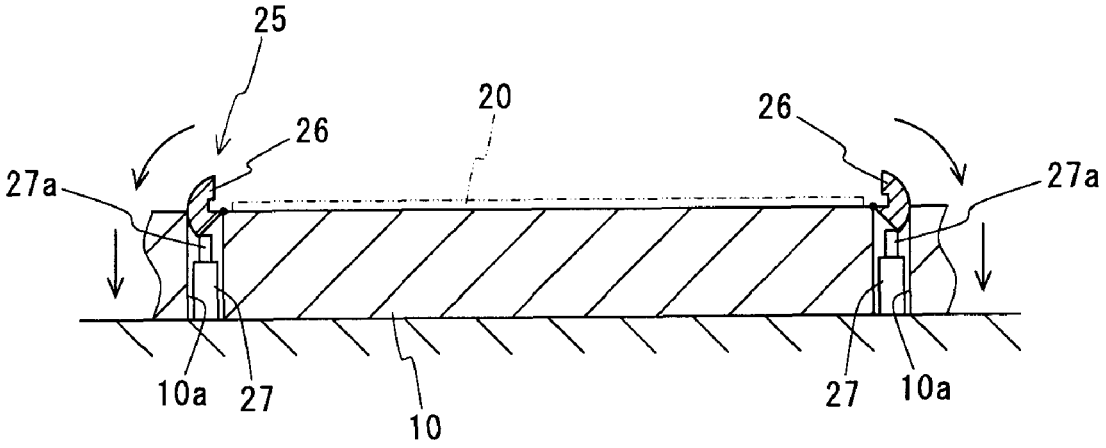
FIG. 6 is a cross-sectional view as viewed in the arrow B-B direction in FIG. 3.

With reference to accompanying drawings, specific embodiments of the present invention will be described below. FIG. 1 is a perspective view illustrating a schematic configuration of a bowling game system according to one embodiment of the present invention. FIG. 2 is a plan view illustrating the bowling game system shown in FIG. 1. FIG. 3 and FIG. 4 are cross-sectional views as viewed in the arrow A-A direction in FIG. 2. FIG. 5 and FIG. 6 are cross-sectional views as viewed in the arrow B-B direction in FIG. 3.

As illustrated in FIG. 1 to FIG. 6, a bowling game system 1 of this embodiment includes: an approach 10 for allowing a player to carry out a bowling action; a lane 11 extending from the approach 10 and on which a ball bowled by the player rolls; ten pins 12 arranged and placed on an end of the lane 11 opposite an approach 10 side; trough-like gutters 13 provided paralleling both sides of the lane 11; a protection member 20 laid in a player's bowling action zone on a top surface of the approach 10 so as to cover the bowling action zone; a protection-member installing mechanism 30 for moving the protection member 20 to a position that covers the bowling action zone and a retracting position outside the bowling action zone; and a clamping mechanism 25 for clamping the protection member 20 laid in the bowling action zone on the top surface of the approach 10. The bowling game system 1 is configured with plural sets of these components placed adjacently in the horizontal direction.

A separator 14 is provided between the gutters 13 positioned parallel and adjacent to each other. Play zones each configured with the lane 11 and the gutters 13 are separated each other by the separator 14. A partition wall 15 is provided between the gutters 13 on both sides of where the pins 12 are placed. The play zones also are separated by the partition wall 15. A cover 16 is provided over the lane 11 between the partition walls 15, and the ten pins 12 are placed on the lane 11 in a space surrounded by this cover 16 and the partition walls 15. The approach 10, the lane 11, the gutters 13, etc., are appropriately arranged on an installing surface S.

The protection member 20 is formed in a sheet-like shape and a rectangular shape, and configured to have flexibility. Both sides of the protection member 20 in the width direction are provided parallel with a lengthwise direction of the lane 11. A length in the width direction of the protection member 20 is formed to be approximately equal to a distance between the separators 14.

The protection-member installing mechanism 30 is provided outside the bowling action zone, and is configured with a wind-in device 31 for winding in the protection member 20 and a withdrawing device 34 for withdrawing the protection member 20 from the wind-in device 31.

The wind-in device 31 is so placed that an axis thereof is parallel with the width direction of the lane 1, and includes: a wind-in drum 32, connected with one end side of the protection member 20, for winding in the protection member 20; a spring body (not shown) for biasing the wind-in drum 32 to a predetermined winding-in direction (an arrow direction in FIG. 4); and a case 33, provided on the installing surface S to contact a side surface of an end of the approach 10 opposite a side of the lane 11, for containing therein the wind-in drum 32 and the spring body (not shown).

The case 33 is so formed that its side surface on a side contacting the approach 10 is opened and a ceiling surface of an internal space is higher than the top surface of the approach 10. From an opening 33*a* formed between the ceiling surface and the top surface of the approach 10, the protection member 20 is pulled in and out. The case 33 rotatably supports the wind-in drum 32.

The withdrawing device 34 includes: wire ropes 35 of which the one end sides are each connected to portions serving not only as width-direction both ends of the protection member 20 but also serving as ends opposite a connection side of the wind-in drum 32; wind-in drums 37 of which the axes are placed parallel with the width direction of the lane 11, the wind-in drums 37, being connected with the other ends of the wire ropes 35 via pulleys 36, for winding in the wire ropes 35; drive motors 38 for rotating the wind-in drums 37 about their axes; and cases 39, arranged on the side of the approach 10 of the separator 14, for containing therein the pulleys 36, the wind-in drums 37, and the drive motors 38. Two pulleys 36, wind-in drums 37, drive motors 38, and cases 39 are each provided to correspond to each wire rope 35.

The cases 39 are so formed that its lower-surface height position is placed to be higher than the top surface of the approach 10 and its lower surface is opened. The cases 39 rotatably support the pulleys 36 and the wind-in drums 37. The cases 39 contain therein also the pulley 36, the wind-in drums 37, and the drive motors 38, each of which components serves to withdraw the protection member 20 that covers the bowling action zone related to the adjacent lane 11.

According to the protection-member installing mechanism 30, as shown in FIG. 3, when the wind-in drum 37 is rotated by the drive motor 38 of the withdrawing device 34 in a winding-in direction (arrow direction) of the wire rope 35, the wire rope 35 is wound onto the wind-in drum 37. As a result, the wind-in drum 32 of the wind-in device 31 is rotated to a winding-out direction (arrow direction) of the protection member 20 against a biasing force of the spring body (not shown), and thereby, the protection member 20 that has been wound onto the wind-in drum 32 is wound out within the bowling action zone. As a result, the protection member 20 is laid in the bowling action zone. The protection member 20 is wound out until an tip end thereof (end on the lane 11 side) reaches a borderline between the approach 10 and the lane 11.

On the other hand, as shown in FIG. 4, when the wind-in drum 37 is rotated by the drive motor 38 of the withdrawing device 34 in a winding-out direction of the wire rope 35 (arrow direction), the wire rope 35 is wound out from the wind-in drum 37. As a result, the wind-in drum 32 of the wind-in device 31 is rotated by the biasing force of the spring body (not shown) in a winding-in direction (arrow direction) of the protection member 20, and thereby, the protection member 20 that has been wound out within the bowling action zone is wound onto the wind-in drum 32. Thereby, the protection member 20 is collected in a retracting position. The protection member 20 is wound until the tip end thereof (end on the lane 11 side) is in a state of being pulled out slightly from the case 33.

The clamping mechanism 25 is that which presses on four corners of the protection member 20 laid in the bowling action zone to fix the protection member 20 on the top surface of the approach 10, and is configured with: pressing members 26 for pressing, attached on the top surface of the approach 10 pivotally about their axes parallel with the lengthwise direction of the lane 11, the pressing members 26 being in contact with a surface of the protection member 20; spring bodies (not shown) for biasing the pressing members 26 in a direction apart from the surface of the protection member 20 (arrow direction in FIG. 6); and drive cylinders 27, arranged below the pressing members 26, which each includes an elevating rod 27*a* in contact with the pressing member 26. The drive cylinders 27 are each placed within a containing hole 10*a* that is opened to the top surface of the approach 10 and is provided respectively on width-direction both sides of the protection member 20 at the wind-in device 31 side and the withdrawing device 34 side.

According to the clamping mechanism 25, as shown in FIG. 5, when the elevating rod 27*a* of the drive cylinder 27 is raised, the pressing member 26 is pivoted against a biasing force of the spring body (not shown) in a surface side (arrow direction) of the protection member 20. Thereby, the surface of the protection member 20 is forced down on the top surface of the approach 10, and as a result, the protection member 20 is fixed.

On the other hand, as shown in FIG. 6, when the elevating rod 27*a* of the drive cylinder 27 is descended, the pressing member 26 is pivoted by the biasing force of the spring body (not shown) in a direction apart from the surface of the protection member 20 (arrow direction). Thereby, the clamping of the protection member 20 by the pressing member 26 is canceled.

The protection-member installing mechanism 30 and the clamping mechanism 25 are controlled to clamp the protection member 20 after winding out the protection member 20 to the bowling action zone, and to wind in the protection member 20 after canceling the clamping of the protection member 20.

According to the thus-configured bowling game system 1 of this embodiment, when a player who does not change into bowling shoes plays, for example, if a laying execution button not shown is appropriately depressed, and so on, the protection-member installing mechanism 30 and the clamping mechanism 25 are driven. Thereby, the protection member 20 is wound out by the withdrawing device 34 of the protection-member installing mechanism 30 to the bowling action zone. As a result, the bowling action zone is covered with the protection member 20, and the protection member 20 is fixed by the clamping mechanism 25 on the top surface of the approach 10.

Thereafter, the player, with his own shoes on, carries out a bowling action in the bowling action zone on the top surface of the approach 10 covered with the protection member 20, and plays a bowling game by bowling a ball onto the lane 11 so as to strike the ball against the pins 12 to be knocked down.

On the other hand, when a player who changes into bowling shoes plays, for example, if a laying cancel button not shown is appropriately depressed, and so on, the protection-member installing mechanism 30 and the clamping mechanism 25 are driven. Thereby, the clamping of the protection member 20 by the clamping mechanism 25 is canceled, and the protection member 20 is wound by the wind-in device 31 of the protection-member installing mechanism 30.

Thereafter, the player carries out a bowling action in the bowling action zone on the top surface of the approach 10 not covered with the protection member 20, and bowls the ball onto the lane 11 so as to play the bowling game.

In this way, according to the bowling game system 1 of this embodiment, when the protection member 20 is laid by the protection-member installing mechanism 30 in the bowling action zone on the top surface of the approach 10, the player can play with his own shoes on without changing into bowling shoes. This eliminates the reluctance to change into shoes put on by others and shoes poor in design, which allows the player to play more comfortably, the player is allowed to play more easily because there is no need of changing the shoes, and a playing charge can be lowered because there is no need of paying a rental fee of the bowling shoes.

Further, by the clamping mechanism 25, the four corners of the protection member 20 laid in the bowling action zone are pressed on to fix the protection member 20 on the top surface of the approach 10. This clamping prevents the protection member 20 from moving and being turned over at a time of bowling by the player, thereby, enabling the player to play safely, and also from being damaged resulting from the approach 10 being directly treaded by the player.

As described above, one embodiment of the present invention is described, and a specific mode in which the present invention can be implemented is not limited thereto at all.

In the above-described embodiment, the protection-member installing mechanism 30 is configured with the wind-in device 31 and the withdrawing device 34, but the configuration is not limited thereto. For example, the protection-member installing mechanism 30 may be a protection-member installing mechanism 50 as shown in FIG. 7 to FIG. 9 or a protection-member installing mechanism 70 as shown in FIG. 10 to FIG. 13 or a protection-member installing mechanism 80 as shown in FIG. 14.

Figure 7:
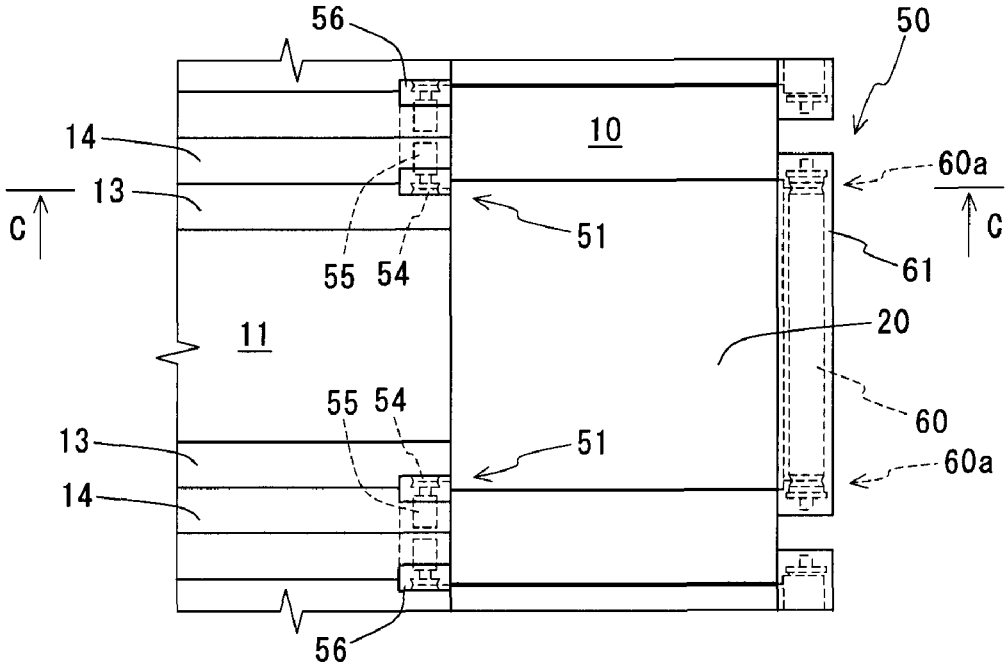
FIG. 7 is a plan view illustrating a schematic configuration of a protection-member installing mechanism according to another embodiment of the present invention.
Figure 8:
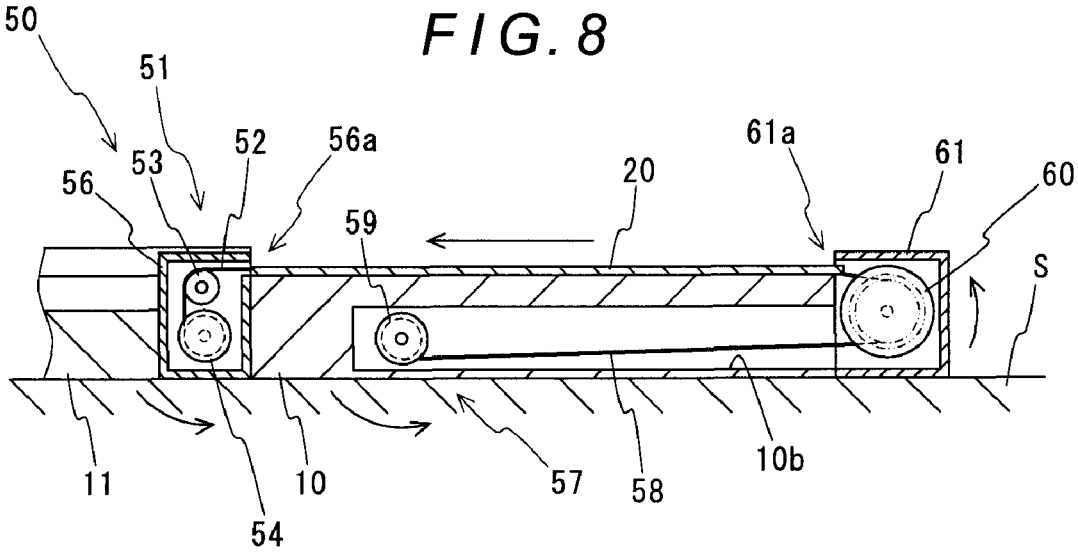
FIG. 8 is a cross-sectional view as viewed in the arrow C-C direction in FIG. 7.
Figure 9:
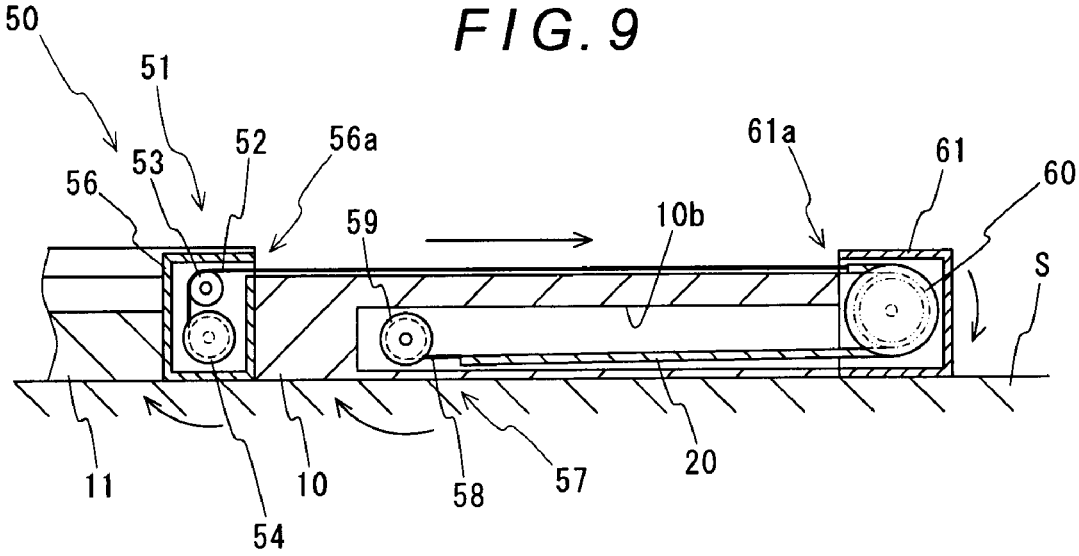
FIG. 9 is a cross-sectional view as viewed in the arrow C-C direction in FIG. 7.
Figure 10:
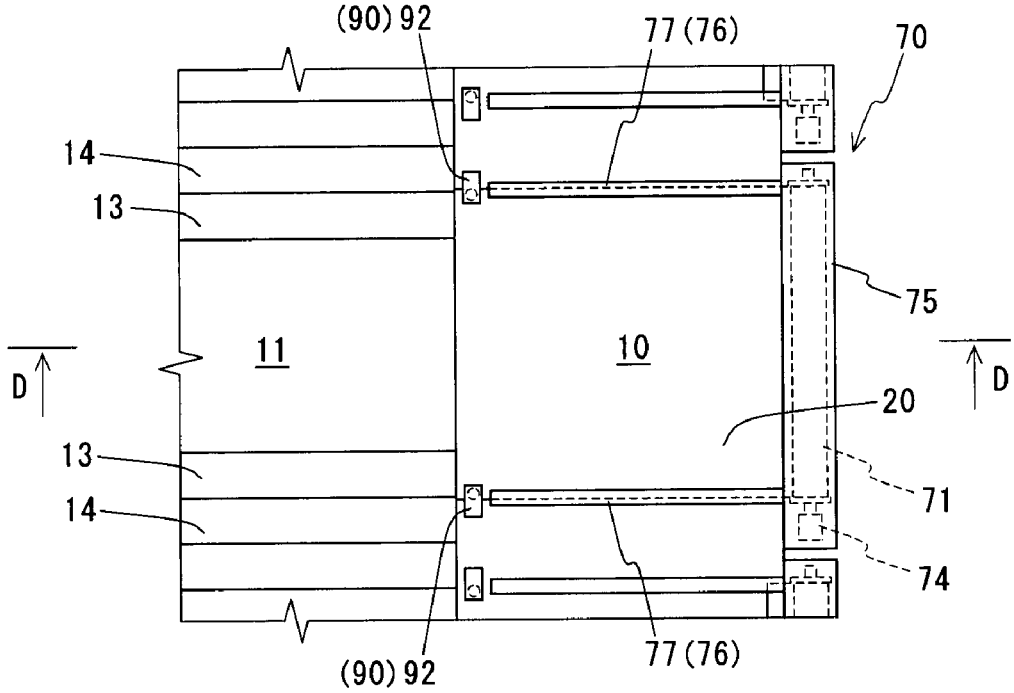
FIG. 10 is a plan view illustrating schematic configurations of the protection-member installing mechanism and a clamping mechanism according to another embodiment of the present invention.

The protection-member installing mechanism 50, as shown in FIG. 7 to FIG. 9, is configured with: a first drive device 51 and a second drive device 57, each connected to the both ends in the lengthwise direction of the lane 11 of the protection member 20, for moving the protection member 20; and a roller 60, provided between the first drive device 51 and the second drive device 57 in a moving direction of the protection member 20, for reversing the moving direction of the protection member 20.

The first drive device 51 includes: wire ropes 52 of which the one end sides are each connected to portions serving not only as the width-direction both ends of the protection member 20 but also serving as ends on the lane 11 side; wind-in drums 54 of which the axes are placed parallel with the width direction of the lane 11, the wind-in drums 54, being connected with the other ends of the wire ropes 52 via pulleys 53, for winding the wire ropes 52; drive motors 55 for rotating the wind-in drums 54 about their axes; and cases 56, arranged on the approach 10 side of the separator 14, for containing therein the pulleys 53, the wind-in drums 54, and the drive motors 55. Two pulleys 53, wind-in drums 54, drive motors 55, and cases 56 are each provided to correspond to each wire rope 52.

The cases 56 are so formed that a ceiling surface of its internal space is higher than the top surface of the approach 10 and above the top surface of the approach 10, of the side surface on the approach 10 side, an opening 56*a* is formed. From this opening 56*a*, the wire ropes 52 are pulled in and out. The cases 56 support rotatably the pulleys 53 and the wind-in drums 54. The cases 56 contain therein also the pulleys 53, the wind-in drum 54, and the drive motor 55, for moving the protection member 20 related to the adjacent lane 11.

The second drive device 57 includes: wire ropes 58 of which the one end sides are each connected to portions serving not only as the width-direction both ends of the protection member 20 but also serving as ends opposite the connections side of the wire rope 52 of the first drive device 51; wind-in drums 59, of which the axes are placed parallel with the width direction of the lane 11, and which are supported rotatably about their axes, the wind-in drums 59, being connected with the other end sides of the wire ropes 58, for winding the wire ropes 58; and drive motors (not shown) for rotating the wind-in drums 59 about the axes. The wind-in drums 59 and the drive motors (not shown) are contained within a containing hole 10*b* opening to a side surface of an end opposite the lane 11 side of the approach 10. Two wind-in drums 59 and drive motors (not shown) are each provided to correspond to each wire rope 58.

The roller 60 is so formed that its axis is placed parallel with the width direction of the lane 11 and its outer circumferential surface is placed in contact with a bottom surface of the protection member 20, and is supported rotatably inside the case 61 provided on the installing surface S so as to contact the side surface of the end of the approach 10 opposite the lane 11 side. On the both ends of the roller 60, grooves 60*a* for hanging the wire ropes 58 of the second drive devices 57 are formed.

The case 61 is so formed that a side surface on a side contacting the approach 10 is opened so that the internal space and the containing hole 10*b* of the approach 10 are provided in a communicated state, and a ceiling surface of the internal space is higher than the top surface of the approach 10. From an opening 61*a* formed between the ceiling surface and the top surface of the approach 10, the protection member 20 is pulled in and out.

According to the thus-configured protection-member installing mechanism 50, as shown in FIG. 8, when the wind-in drums 54 are rotated by the drive motors 55 of the first drive devices 51 in a winding-in direction (arrow direction) of the wire ropes 52, the wire ropes 52 are wound onto the wind-in drums 54, and when the wind-in drums 59 are rotated by the drive motors (not shown) of the second drive devices 57 in a winding-out direction (arrow direction) of the wire ropes 58, the wire ropes 58 are wound out from the wind-in drum 59. As a result, the protection member 20 in the retracting position is moved to the bowling action zone. At this time, the protection member 20 slides and moves in the lengthwise direction of the lane 11 on a top surface portion of the approach 10, and is moved until a tip end (end on the lane 11 side) of the protection member 20 reaches a borderline between the approach 10 and the lane 11. Thereby, the protection member 20 is sent out to the bowling action zone so as to be laid therein.

On the other hand, as shown in FIG. 9, when the wind-in drums 54 are rotated by the drive motors 55 of the first drive devices 51 in a winding-out direction (arrow direction) of the wire ropes 52, the wire ropes 52 are wound out from the wind-in drums 54, and when the wind-in drums 59 are rotated in a winding-in direction (arrow direction) of the wire ropes 58 by the drive motors (not shown) of the second drive devices 57, the wire ropes 58 are wound onto the wind-in drums 59. As a result, the protection member 20 in the bowling action zone is moved to the retracting position formed by the containing hole 10*b* of the approach 10 and the internal space of the case 61. At this time, the protection member 20 slides and moves parallel with the lengthwise direction of the lane 11 on the top surface portion of the approach 10, and is moved until the tip end (end on the lane 11 side) of the protection member 20 is contained within the case 61. Thereby, the protection member 20 is pulled in the retracting position.

The protection-member installing mechanism 70, as shown in FIG. 10 to FIG. 13, is configured with: a first roller 71, a second roller 72, and a third roller 73, of which the axes are placed parallel with the width direction of the lane 11, for moving the protection member 20; a drive motor 74 for rotating the first roller 71 about its axis; a case 75, provided on the installing surface S so as to contact the side surface on the end of the approach 10 opposite the lane 11 side, for containing therein the first roller 71, the second roller 72, the third roller 73, and the drive motor 74; and a guiding mechanism 76 for guiding the movement of the protection member 20.

The first roller 71 is so supported rotatably about its axis by the case 75 that an outer circumferential surface of the first roller 71 is in contact with the bottom surface of the protection member 20. The second roller 72 and the third roller 73 are so supported rotatably about its axes by the case 75 that outer circumferential surfaces of these rollers are in contact with the surface of the protection member 20. As a result, the protection member 20 is in a state of being sandwiched by each of these rollers 71, 72, and 73.

The case 75 is so formed that a side surface on a side contacting the approach 10 is opened, its internal space and the containing hole 10*b* that is opened to the side surface on the end of the approach 10 opposite the lane 11 side are provided in a communicated state, and a ceiling surface of the internal space is higher than the top surface of the approach 10. From an opening 75*a* formed between the ceiling surface and the top surface of the approach 10, the protection member 20 is pulled in and out.

The guiding mechanism 76 is formed by: a first guiding member 77 provided on the top surface of the approach 10 and provided upright to have a constant distance in a direction parallel to the width direction of the lane 11; and a second guiding member 78 provided within the containing hole 10*b* of the approach 10 and provided to have a constant distance in a direction parallel to the width direction of the lane 11. The first guiding member 77 and the second guiding member 78 are formed parallel with the lengthwise direction of the lane 11, and are engaged with the width-direction both ends of the protection member 20 so as to guide the movement of the protection member 20 in the lengthwise direction of the lane 11. The reason for the provision of the guiding members 77 and 78 is to secure a smooth movement of the protection member 20, which is preferable for moving the protection member 20.

Figure 11:
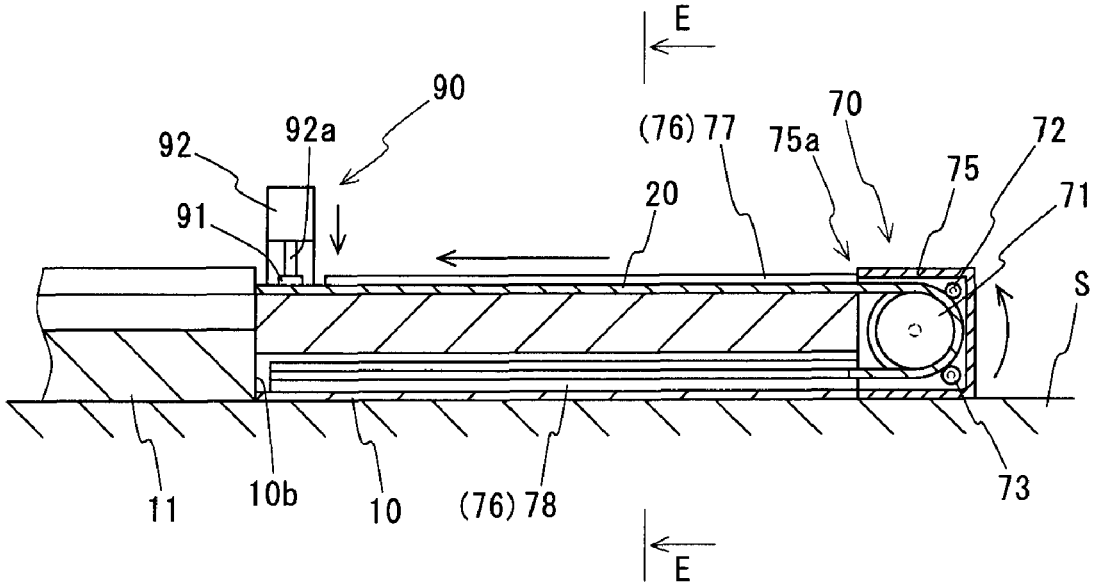
FIG. 11 is a cross-sectional view as viewed in the arrow D-D direction in FIG. 10.

According to the thus-configured protection-member installing mechanism 70, as shown in FIG. 11, when the first roller 71 is rotated in an arrow direction by the drive motor 74, the protection member 20 in the retracting position is guided by the first guiding member 77 and the second guiding member 78 to be moved to the bowling action zone. At this time, the protection member 20 slides and moves parallel with the lengthwise direction of the lane 11 on the top surface portion of the approach 10, and is moved until a tip end (end on the lane 11 side) of the protection member 20 reaches a borderline between the approach 10 and the lane 11. Thereby, the protection member 20 is sent out to the bowling action zone so as to be laid therein.

Figure 12:
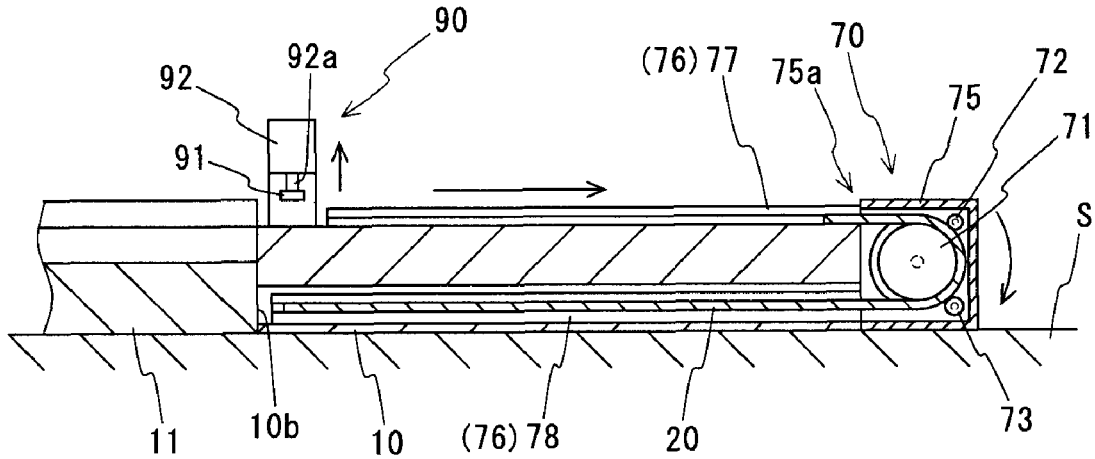
FIG. 12 is a cross-sectional view as viewed in the arrow D-D direction in FIG. 10.

On the other hand, as shown in FIG. 12, when the first roller 71 is rotated by the drive motor 74 in the arrow direction, the protection member 20 in the bowling action zone is guided by the first guiding member 77 and the second guiding member 78 to be moved to the retracting position formed by the containing hole 10*b* of the approach 10 and the internal space of the case 75. At this time, the protection member 20 sidles and moves parallel with the lengthwise direction of the lane 11 on the top surface portion of the approach 10, and is moved until the tip end (end on the lane 11 side) of the protection member 20 is in a state of being slightly pulled out from the case 75. Thereby, the protection member 20 is pulled in the retracting position.

The protection-member installing mechanism 80, as shown in FIG. 14, is so placed that an axis thereof is parallel with the lengthwise direction of the lane 11, and is configured with: a first roller 81, second rollers 82, and third rollers 83, for moving the protection member 20; and a drive motor (not shown) for rotating the first roller 81 about its axis. In the approach 10, an upwardly protruding protrusion 10*c* is formed at an approximately same position as that of the separator 14 in the width direction of the lane 11, and on one side surface of the protrusion 10*c* in a direction parallel to the width direction of the lane 11, a containing hole 10*d* for containing the first roller 81, the second rollers 82, the third rollers 83, the drive motor (not shown), or the protection member 20 is opened.

The first roller 81 is placed rotatably about its axis near an opening of the containing hole 10*d* and is so configured that an outer circumferential surface is in contact with the bottom surface of the protection member 20; the second rollers 82 are placed rotatably about their axes above the first roller 81 and one of the third rollers 83, and are so configured that outer circumferential surfaces are in contact with the surface of the protection member 20; and the third rollers 83 are placed rotatably about their axes and at a predetermined distance in the width direction of the lane 11, and are so configured that outer circumferential surfaces are in contact with the bottom surface of the protection member 20. As a result, the protection member 20 is in a state of being sandwiched by each of these rollers 81, 82, and 83.

According to the thus-configured protection-member installing mechanism 80, as shown in FIG. 14, when the first roller 81 is rotated by the drive motor (not shown) in the arrow F direction, the protection member 20 in the retracting position is moved to the bowling action zone. At this time, the protection member 20 slides and moves parallel with the width direction of the lane 11 on the top surface portion of the approach 10, and is moved until the tip end of the protection member 20 approaches the other side surface of the protrusion 10*c* related to the adjacent lane 11 in a direction parallel to the width direction of the lane 11. Thereby, the protection member 20 is sent out to the bowling action zone so as to be laid therein.

On the other hand, as shown in FIG. 14, when the first roller 81 is rotated in the arrow G direction by the drive motor (not shown), the protection member 20 in the bowling action zone is moved within the containing hole 10*d* of the approach 10, which is the retracting position. At this time, the protection member 20 slides and moves parallel with the width direction of the lane 11 on the top surface portion of the approach 10, and is moved until the tip end of the protection member 20 is contained in the containing hole 10*d*. Thereby, the protection member 20 is pulled in the retracting position.

A configuration of the clamping mechanism 25 may not be limited to that in the above-described embodiment, and the clamping mechanism 25 may be configured as shown in FIG. 10 to FIG. 13, for example. A clamping mechanism 90 shown in FIG. 10 to FIG. 13 is configured with: pressing members 91 for contacting and pressing the surface of the protection member 20; and drive cylinders 92, each arranged on the top surface of the approach 10 and on both sides in the width direction of the lane 11 side of the protection member 20, the drive cylinders 92 being including, at lower ends, elevating rods 92*a* for supporting the pressing members 91.

Figure 13:
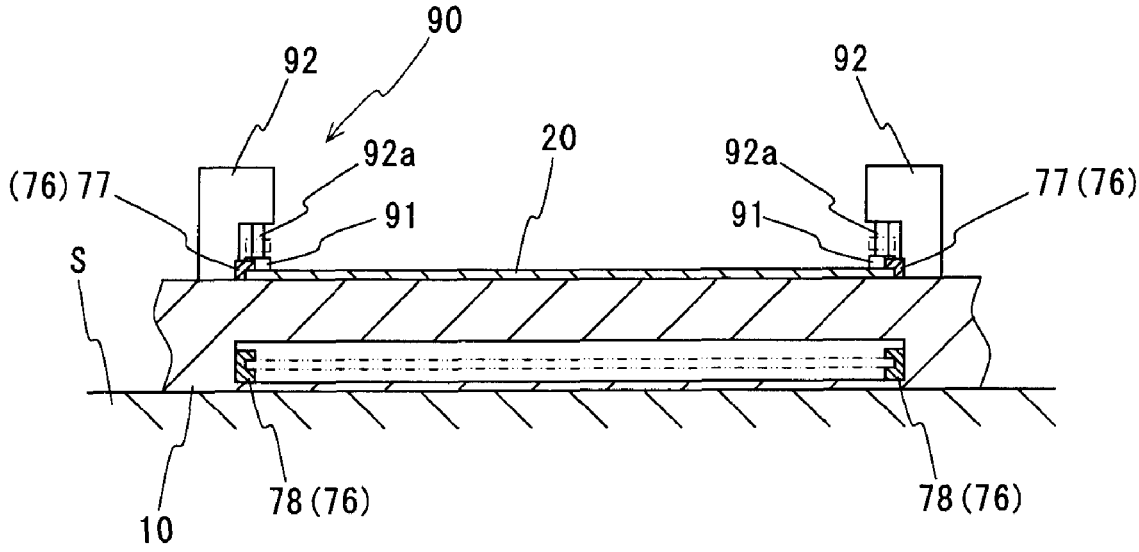
FIG. 13 is a cross-sectional view as viewed in the arrow E-E direction in FIG. 11.
Figure 14:
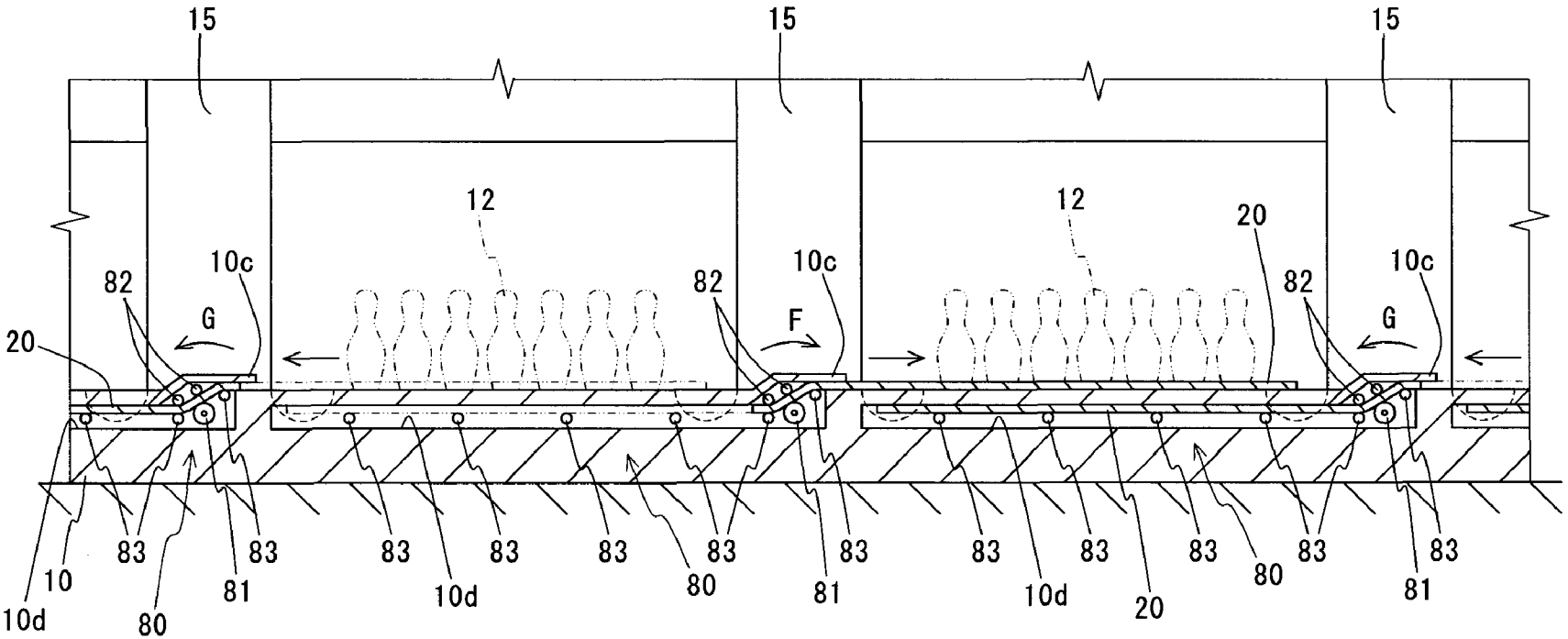
FIG. 14 is a cross-sectional view illustrating a schematic configuration of the protection-member installing mechanism according to another embodiment of the present invention.

According to the thus-configured clamping mechanism 90, as shown in FIG. 11 and FIG. 13, when the elevating rods 92*a* of the drive cylinders 92 are descended, the pressing members 91 contact the surface of the protection member 20 and the surface of the protection member 20 is forced down on the top surface of the approach 10. Thereby, the protection member 20 is fixed.

On the other hand, as shown in FIG. 12 and FIG. 13, when the elevating rods 92*a* of the drive cylinders 92 are raised, the pressing members 91 are kept apart from the surface of the protection member 20. Thereby, the clamping of the protection member 20 by the pressing members 91 is canceled.

The clamping mechanism 25 or the clamping mechanism 90 may adopt a flat structure that does not greatly protrude from the top surface of the approach 10, if possible.

In each of the protection-member installing mechanisms 30, 50, 70, and 80, the direction in which the protection member 20 is moved is exemplary, and is not limited. In each of the protection-member installing mechanisms 30 and 50, the wire ropes 35 and 52 are provided above the approach 10, but are not limited thereto. A groove may be appropriately formed on the top surface of the approach 10 so that the wire ropes 35 and 52 pass therethrough.

The protection member 20 is not limited to a member having flexibility and may be configured with a member not having flexibility. Further, the protection member 20 may be configured with a film-shaped, sponge-shaped, or rubber-shaped member, or may be configured by joining a plurality of plate-shaped members in a predetermined direction. When a roller is appropriately provided on the bottom surface of the protection member 20 or the top surface of the approach 10 to prevent a direct contact between the top surface of the approach 10 and the bottom surface of the protection member 20, damaging the top surface of the approach 10 may be prevented.

INDUSTRIAL APPLICABILITY

As described in detail above, the present invention can be preferably applied to a bowling game system in which for enjoyment pins arranged and placed on the lane are knocked down by the rolling ball.

The invention claimed is:

1. A bowling game system, comprising:

an approach for allowing a player to carry out a bowling action;

a lane extending from the approach and on which the ball bowled by the player rolls;

a plurality of pins arranged and placed on an end of the lane opposite a side of the approach; and trough-like gutters provided paralleling both sides of the lane to receive a ball slipping off the lane, the bowling game system, further comprising:

a protection member, formed in a sheet-like shape, for covering a bowling action zone, the protection member being laid in the bowling action zone of the player, the bowling action zone being on a top surface of the approach; and a protection-member installing mechanism for carrying out an action of moving the protection member to a position covering the bowling action zone and an action of moving the protection member to a retracting position outside the bowling action zone.

2. The bowling game system according to claim 1, wherein the protection-member installing mechanism is configured with: winding-in means for winding in the protection member, the winding-in means being provided outside the bowling action zone and being connected with one end of the protection member; and withdrawing means for withdrawing the protection member from the winding-in means, the withdrawing means being connected with an end of the protection member opposite a side of a connection of the winding-in means, and the protection-member installing mechanism is so configured that the protection member is wound out by the withdrawing means to within the bowling action zone and the protection member present within the bowling action zone is wound and collected by the winding-in means to the retracting position.

3. The bowling game system according to claim 1, wherein the protection-member installing mechanism is configured with driving means that is connected to the protection member, for sliding and moving the protection member in a first direction parallel to a surface of the protection member so as to move the protection member to the bowling action zone while sliding and moving the protection member in a second direction opposite the first direction so as to move the protection member to the retracting position.

4. The bowling game system according to claim 3, wherein the protection-member installing mechanism, further comprising guiding means for guiding a movement of the protection member in the first direction and the second direction.

5. The bowling game system according to any one of claims 1 to 4, further comprising clamping means for clamping at least one portion of a periphery of the protection member laid in the bowling action zone, on the top surface of the approach.

* * * * *